United States Patent [19]

Muckli

[11] 4,291,564

[45] Sep. 29, 1981

[54] METHOD OF AND APPARATUS FOR ROLLING SHEET STEEL PROFILES OF DIFFERENT CROSS-SECTIONAL SHAPE IN UNIVERSAL BEAM ROLLING MILL TRAINS

[75] Inventor: Heinz Muckli, Ratingen, Fed. Rep. of Germany

[73] Assignee: Schloemann-Siemag Aktiengesellschaft, Dusseldorf, Fed. Rep. of Germany

[21] Appl. No.: 104,381

[22] Filed: Dec. 17, 1979

[30] Foreign Application Priority Data

Dec. 21, 1978 [DE] Fed. Rep. of Germany ..... 2855287

[51] Int. Cl.[3] ..... B21B 1/12

[52] U.S. Cl. ..... 72/234; 72/225; 72/366

[58] Field of Search ..... 72/234, 225, 221, 229, 72/366

[56] References Cited

FOREIGN PATENT DOCUMENTS 47-47784 12/1972 Japan ..... 72/234

*Primary Examiner*—Milton S. Mehr

*Attorney, Agent, or Firm*—Holman & Stern

[57] ABSTRACT

Sheet steel profiles are rolled in a rolling line including a number of rolling mills. The starting material is first reduced and shaped conventionally in successive mills, and then the final rolling takes place initially by preliminary bending of the sheet steel profiles to the starting (first pass) shape. At this stage, the interlocking joint portion of the profiles are given a shape suitable for the finished profile. The finishing pass is then performed to give the profile cross-section its finished dimensions. All these final rolling operations take place continuously and in one direction.

11 Claims, 11 Drawing Figures

METHOD OF AND APPARATUS FOR ROLLING SHEET STEEL PROFILES OF DIFFERENT CROSS-SECTIONAL SHAPE IN UNIVERSAL BEAM ROLLING MILL TRAINS

FIELD OF THE INVENTION

The invention relates to a method and to apparatus for the rolling of sheet profiles (e.g. filing profiles) of different cross-sectional shape in universal beam rolling mill trains, in which the starting material undergoes preliminary rolling in a two-high reversing beam rolling mill, a two-high reversing preliminary rolling mill, and in one or more universal rolling mills, each of which has its associated flange edging mill, all these operations taking place in reverse operating mode and in a number of pass sequences, and the stock is rolled to the final profile in the following finishing rolling mill.

BACKGROUND OF THE INVENTION

A method of rolling beam profiles and sheet piling profiles as set forth above has already been proposed on the basis of the article "Progress in Section-Rolling Technology in Japan" taken from the NL-Literature source "Journal of Mechanical Working Technology 1 (1977) 3–34", published by the Elsevier Scientific Publishing Company. According to this method the final rolling of the sheet steel piling profiles takes place in a two-high reversing finishing rolling mill, the finished profile being arrived at by means of a number of rolling passes carried out with different roller grooves. The rolling mill is of very wide dimensions owing to the use of a number of roller grooves, which lie side by side, are required for final (finishing) rolling in a two-high reversing finishing rolling mill, and lie on the barrels (bodies) of the sets of two-high rollers. As a result of this and also as a result of the rigidity of the rolling mill—this rigidity being required for rolling the final or finished profile in such a way that the required tolerances and observed—the rolling mill is very heavy and expensive. The necessary provision of a reversing drive also contributes to the great weight and expense. Finally, the profile width is limited by reason of the maximum permissible barrel (body) length of the rollers which is selected taking into account the degree of bending of the rollers and the inaccuracies, associated with the degree of bending of the rollers, in the observance of the required tolerances of the final product. For rolling beams the two-high finishing rolling mill must be replaced by a universal rolling mill, possibly equipped with a flange edging mill; for this purpose it is necessary to provide high-duty crane units or corresponding changing devices for conveying the very heavy rolling mills. For rolling the sheet steel piling profiles it is also necessary to provide, on both sides of the two-high reversing finishing rolling mills, an expensive conveyor roller table (bed), whose width corresponds to the barrel or body length of the rollers; this roller table or bed may also be equipped with shifter devices; due to the provision of these components the length of the rolling mill train is additionally greatly increased. An expensive reversing drive is indispensable.

OBJECT OF THE INVENTION

Underlying the invention is the object of improving a universal beam rolling mill train in such a way that it is also possible to roll, on this rolling mill train, sheet steel piling profiles of different cross-sectional shape and of greater width, without it thereby being necessary to alter the finishing roller mill or the finishing roller group, operations being carried out continuously and unidirectionally, so that it is possible to dispense with the components which would otherwise be needed for rolling sheet steel piling profiles of the required width, that is to say it is possible to dispense with conveyor roller beds (tables), positioned before and after the rolling mill, a reversing means, and also changeover of rolling mills for rolling sheet steel piling profiles.

SUMMARY OF THE INVENTION

According to the invention there is therefore proposed a method for rolling sheet steel piling profiles of different cross-sectional shape, in which the final rolling is initially carried out by subjecting the sheet steel piling profiles to preliminary bending to the starting (first pass) shape, the interlocking joints, and also their inner profiles, then being given a shape suitable to the finished profile, and subsequently the final (finishing) pass is carried out in which the cross-section of the steel sheet piling profile is rolled so as to give it the correct dimensions and shape, these operations being continuous and unidirectional.

The same method can be implemented with a universal beam rolling mill train having a non-reversible universal finishing rolling mill or with a reversible universal finishing group of rolling mills, consisting of universal finishing rolling mill with a preceding flange edging mill.

According to a further modification of the method only the interlocking joints, and also the profile shape, are, when the steel sheet piling profiles undergo preliminary bending, given a cross-sectional shape appropriate to the starting pass. Further, an additional reduction in the passes, or a higher degree of stretch, is applied in the rolling mill preceding the final rolling group, and a preliminary profile which is suitable for the finishing pass is rolled in the reversing intermediate roller group for the purpose of maintaining tolerances more effectively. The final pass, in which the stock is rolled to the correct dimensions and shape, is carried out between the sets of vertical rollers and/or the sets of horizontal rollers of the final rolling mill.

A rolling method of this kind affords the advantage that, for rolling universal beams and for rolling sheet steel piling profiles, the same finishing mill or the same group of finishing rollers can succeed with a continuous, unidirectional operation solely through inserting a preliminary bending unit. In this way it is possible to dispense with the use of the expensive reversing drive as well as the wide conveyor roller tables (beds), associated with this drive, together with shifter devices and also a mill changing means for changing the heavy finishing rolling mills when the rolling mill is switched to beam rolling. Furthermore, this method also permits the rolling of wider sheet metal piling profiles than has hitherto been usual. Finally, the length of the rolling train can be appreciably shortened by reason of the continuous group of finishing rollers.

The arrangement for carrying out the method consists in that the final rolling process is carried out on a finishing roller group, consisting of flange edging mill and universal rolling mill with a preceding preliminary bending unit.

If the final rolling mill already consists of a nonreversible universal rolling mill, a preliminary bending unit, together with an edging mill, is provided before this nonreversible universal rolling mill.

If there is already provided a finishing roller group, consisting of a reversible universal rolling mill with a flange edging mill positioned before this universal rolling mill, a preliminary bending unit precedes this final rolling group.

The preliminary bending unit consists of one or more successive sets of bending rollers which are arranged in a horizontal plane. The flange edging mill is preferably constituted as a light two-high rolling mill. For rolling universal beam profiles the preliminary bending unit can be laterally moved out of the rolling line, and a roller bed (table) section inserted into the gap formed in the rolling line.

BRIEF DESCRIPTION OF THE DRAWINGS

Further features and advantages of the invention will become apparent from the following description of preferred embodiments, which is to be read in conjunction with the accompanying drawings. In the drawings.

DETAILED DESCRIPTION OF THE PREFERRED EMBODIMENTS

Figure 1:
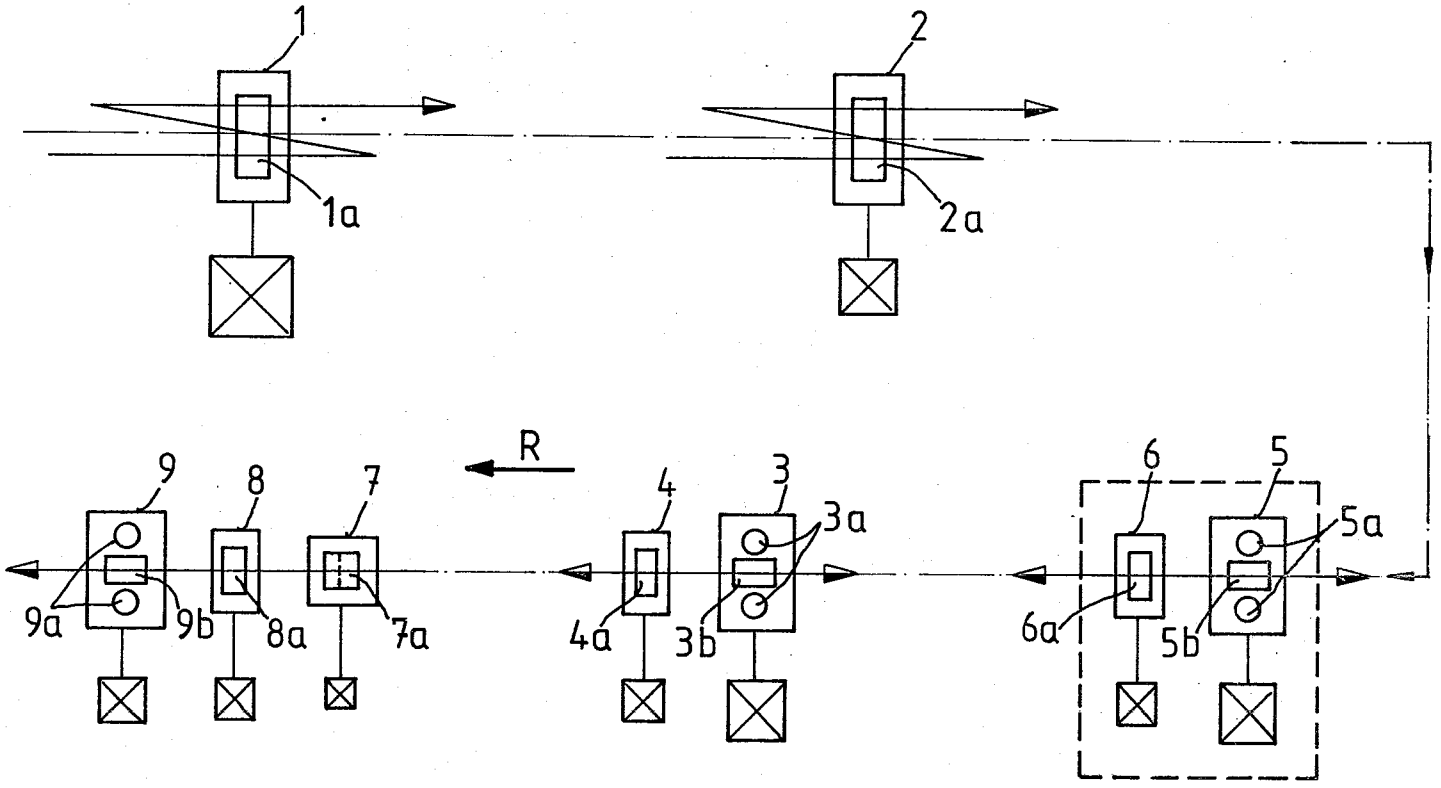
FIG. 1 is a schematic view of the main details of a universal beam rolling train for rolling sheet steel piling according to the proposed method.

FIG. 1 shows the main details of a universal beam rolling train, which can be used both for rolling profile beams and also profiled sheet steel piling of different cross-sectional shapes, preferably Z- and U-sheet steel piling profiles.

In the schematic view of FIG. 1, 1 designates a two-high reversing ingot rolling mill, which subjects to preliminary rolling the starting material or stock, e.g. an ingot or slab, in a number of forward and backward passes in a two-high rolling train with a number of grooved rollers, having differing groove shape, while lie side by side. The starting profile is then reduced, in a two-high set of rollers 2*a* having a number of grooved rollers, of differing groove shape, lying side by side, in a number of forward and backward passes. The starting profile then passes into a universal reversing rolling mill 3, consisting of a set 3*b* of horizontal rollers and a set 3*a* of vertical rollers, these sets 3*a* and 3*b* of rollers lying in a common rolling plane. These sets 3*a* and 3*b* of rollers have grooved rollers and, associated with the latter, a flange edging mills 4, consisting of a two-high set of rollers 4*a* with grooved rollers. The sets of rollers 3 and 4 constitute an intermediate group of rollers, in which the preliminary profile is rolled, in a number of forward and backward passes, for the final group of rollers. The number of rolling passes in the universal reversing rolling mill 3, with associated flange edging mill 4, is limited to about 4 to 5 rolling passes, the number depending on the side to which the stock is being conveyed at any given time; in this way a preliminary profile, suitable for a final rolling pass, is obtained. Accordingly, the reduction per pass, or the degree of stretch, is greater in the upstream-arranged two-high reversing ingot rolling mill 1 and in the two-high reversing rolling mill 2, so as to obtain, in the intermediate group 3, 4 of rollers, a preliminary profile which is suitable for the final rolling pass in respect of profile shape and maintenance of the required tolerances.

The universal reversing rolling mill 3, with its associated flange edging mill 4, may also, as indicated in dashed lines in FIG. 1, be preceded by a further universal reversing rolling mill 5 with which there is associated a flange edging mill 6, with a number of forward and backward passes. This further rolling mill 5 forms part of the intermediate group of rollers, and its provision will depend on the structural design and rolling programme of the universal beam rolling train. The universal reversing rolling mill 5 also has sets 5*b* of horizontal rollers and sets 5*a* of vertical rollers, which lie in a common rolling plane and have grooved rollers. The flange edging mill 6 has two-high sets of rollers 6*a* with grooved rollers. In this case the additional rolling passes are distributed to the intermediate group 5, 6 of rollers for the purpose of limiting the number of passes in the intermediate group 3, 4 of rollers.

The preliminary profile, suitable for the final rolling pass, then runs into the final group of rollers, consisting of a preliminary bending unit 7, consisting of one or more sets 7*a* of bending rollers, the main operation carried out in which is preliminary bending of the steel sheet piling profile P, in particular of the interlocking parts $P_1$, $P_2$, and also of the profile shape, into a cross-sectional form which is suitable for the first pass. In the following flange edging mill 8 the interlocking parts $P_1$, $P_2$, and also their inner profiles, are rolled, in the two-high set 8*a* of rollers, to a shape suitable for the final profile. These units are followed by a universal rolling mill 9 in which the sheet piling profile P is rolled, in a final or finishing pass, to a final profile having the required dimensions and shape. However, this final pass can either be carried out between the sets 9*a* of vertical rollers and the sets 9*b* of horizontal rollers, or only between the sets 9*b* of horizontal rollers. The shaping of the steel sheet piling profile P in the preliminary bending unit 7, and also the subsequent rolling in the flange edging mill 8 and in the universal rolling mill 9, take place in a continous unidirectional sequence in the rolling direction R.

In contradistinction to the prior art rolling train, serving for rolling universal beam profiles or steel sheet piling profiles, in which the final rolling mill consists of a two-high reversing rolling mill, there is provided a rolling mill arrangement which consists, in the final group of rollers, of a preliminary bending unit 7, of a two-high edging mill 8, and of a universal final rolling mill 9, the stock passing continuously in a single direction through the units of this final rolling group.

Insofar as the universal beam rolling train comprises, as finishing rolling mill, a non-reversible universal rolling mill, a preliminary bending unit and a two-high edging roll mill, serving to roll steel sheet piling profiles, are arranged before the non-reversible universal rolling mill and serve as finishing rolling group. The finishing rolling group is controlled so as to function in a continuous, unidirectional operation.

In the case of a group of rolling mills present, in the universal beam rolling trains, in the form of a finishing roller group and consisting of a universal reversing rolling mill with an associated two-high edging mill, the two-high edging mill is solely preceded by a preliminary bending unit. The whole finishing roller group is also operated in a continuous, unidirectional manner for the rolling of steel sheet piling profiles.

Through the use, in particular, of a preliminary bending unit 7 in the finishing roller group of a universal beam rolling train, and through a continuous, unidirectional form of operation, advantages are realized insofar as the use of wide infeed and discharge conveyor roller tables (beds) and expensive reversing drive can be dispensed with. Further, the total length of the rolling train is reduced.

The preliminary bending unit 7 may consist of one or more horizontally disposed bending roller sets 7*a* depending on the particular requirements entailed in the preliminary bending of the steel sheet piling profiles. The flange edging mill 8 of the finishing roller group is constituted as a light two-high rolling mill. For the purpose of rolling universal beam profiles the preliminary bending unit 7 can be shifted laterally out of the line of rollers, and the gap thus produced bridged by a roller table (bed).

In FIGS. 2, 2*a*, 2*b*, 2*c* and 2*d* the sequence of passes is shown, in the intermediate rolling group and finishing rolling group, for Z-shaped sheet steel piling profiles P, and in FIGS. 3, 3*a*, 3*b*, 3*c*, and 3*d* the sequence of passes is shown for U-shaped sheet steel piling profiles P in the individual forming phases and, again, in the intermediate rolling group and finishing rolling group.

Figure 2:
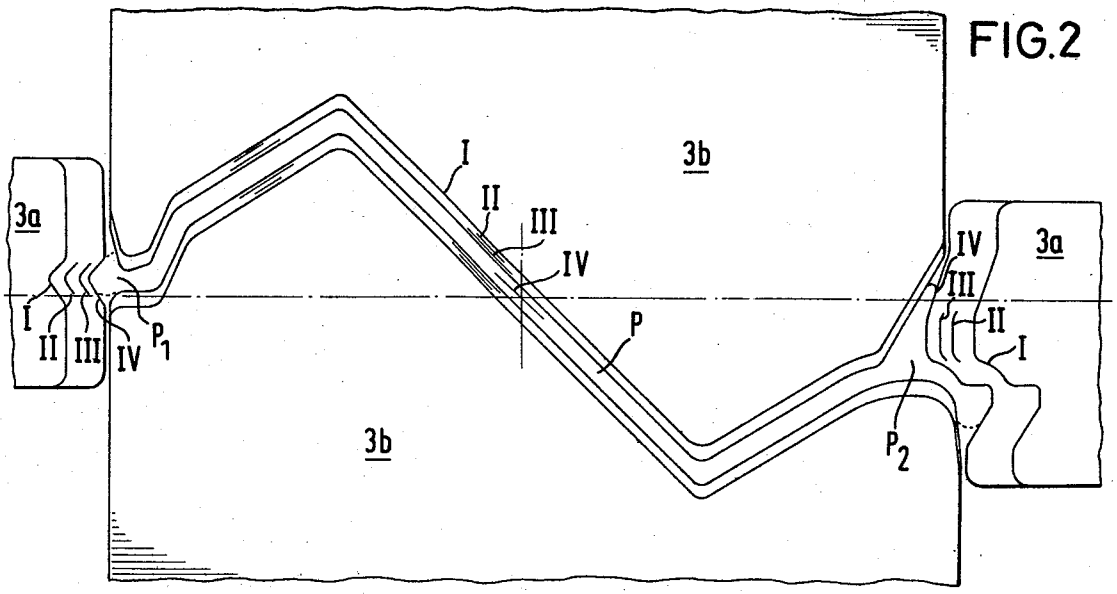
FIGS. 2, 2*a*, 2*b*, 2*c*, 2*d* show the sequence of passes in the intermediate and final group of rollers for Z-shaped sheet steel piling.

FIG. 2 illustrates the rolling of a sheet steel piling profile P of Z-shaped cross-section in the universal reversing rolling mill 3 of the intermediate rolling group in, for example, four reversing passes I, II, III and IV between the set 3*b* of horizontal rollers of the intermediate roller group and the set 3*a* of vertical rollers of the same group. The sheet steel piling profile P is rolled, on all sides and subject to uniform stretching, along the whole width of the profile by the set 3*b* of horizontal rollers and by the set 3*a* of vertical rollers; screw-down adjustment is carried out after each rolling pass. $P_1$ and $P_2$ designates the interlocking joints of the sheet steel piling profile P.

The screw-down adjustment of the vertical rollers of the set 3*a* of vertical rollers, and the screw-down adjustment of the set 3*b* of horizontal rollers, is indicated in dashed lines.

Figure 2A:
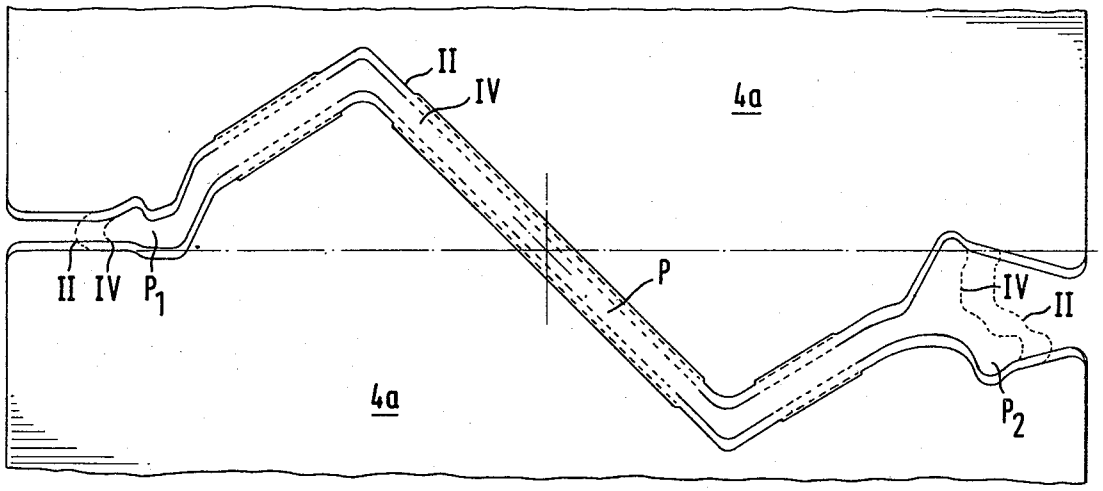

FIG. 2*a* illustrates the rolling of the sheet steel piling profiles P of Z-shaped cross-section in the flange edging mill 4 of the group of intermediate rollers in, for example, two of the reversing passes I to IV as between the two-high set 4*a* of grooved rollers of this flange edging mill 4. The interlocking joints $P_1$ and $P_2$ in particular are further shaped, preferably in the reversing passes II and IV, so as to simultaneously smooth the material displaced by the roll gap present between the set 3*b* of horizontal rollers and the set 3*a* of vertical rollers of the universal reversing rolling mill 3. Also, the sheet steel piling profile P is axially non-slidably guided in the grooved rollers 4*a*.

Figure 2B:
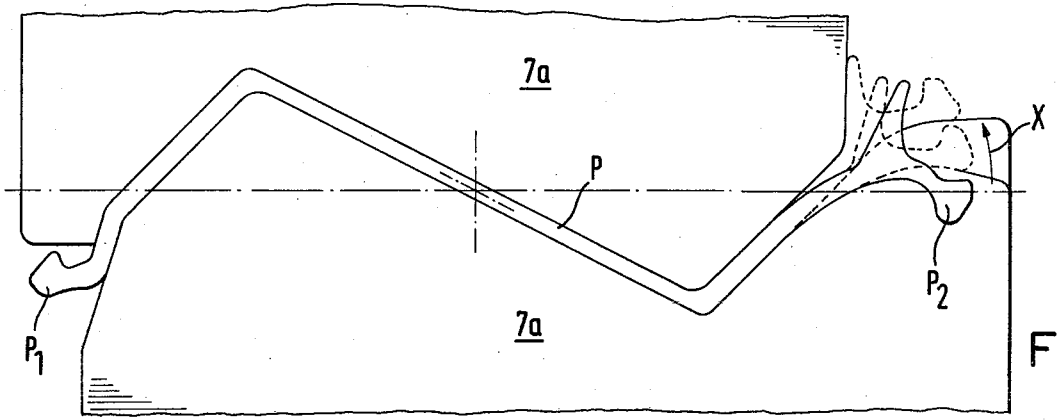

As shown in FIG. 2*b*, the sheet steel piling profile P undergoes preliminary bending between one or more sets 7*a* of bending rollers of the preliminary bending unit 7; the interlocking joints $P_1$, $P_2$ are in particular bent into the shape indicated by dashed lines in the direction of the arrow X.

Figure 2C:
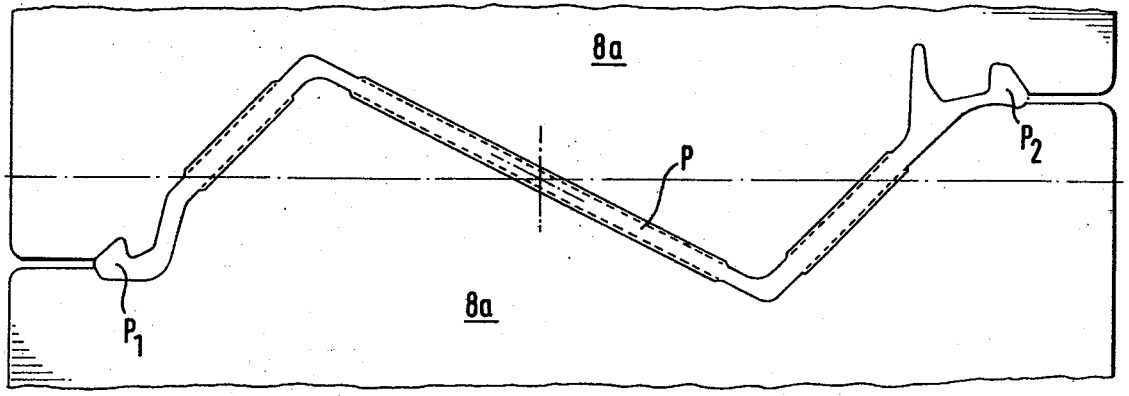

As shown in FIG. 2*c*, the interlocking joints $P_1$, $P_2$, and also their inner profile, are rolled to the required shape in the grooved rollers of the two-high rolling train 8*a* of the flange edging mill 8. The grooves of the horizontal rollers 8*a* are in mutual alignment in the vicinity of the angled section of the sheet steel piling profile P so as to ensure a guidance free of axial displacement.

Figure 2D:
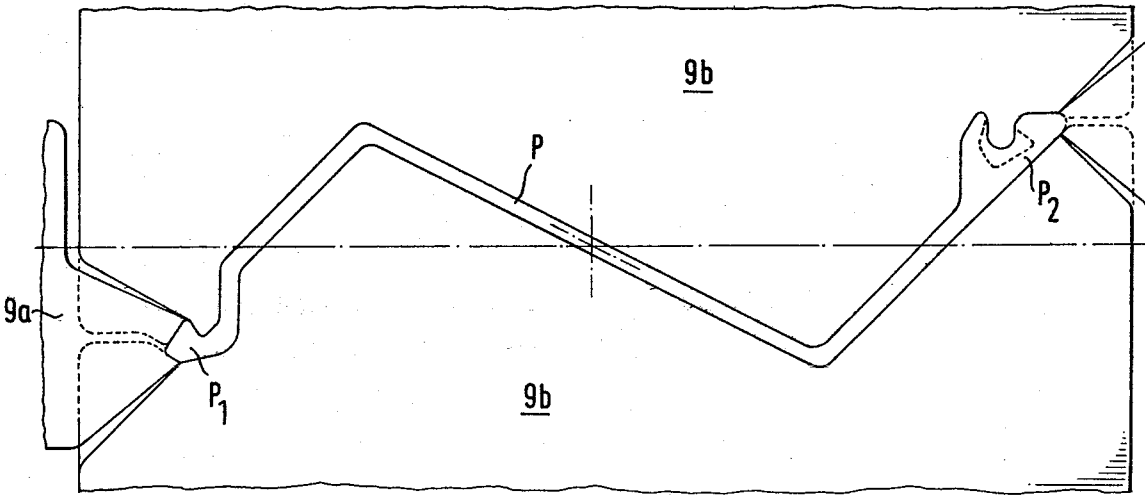

FIG. 2*d* illustrates the finished profile which is finally rolled to the required dimensions and shape in the universal finishing roller mill 9 between the grooves of the set 9*b* of horizontal rollers and of the set 9*a* of vertical rollers. The reduction is about 6 to 8% per pass, and the interlocking joints $P_1$, $P_2$ are given their final shape. As is further illustrated in FIG. 2*d* in dashed lines, the final or finished profile P may, alternatively, undergo the final rolling process only between the set 7*a* of horizontal rollers.

Figure 3:
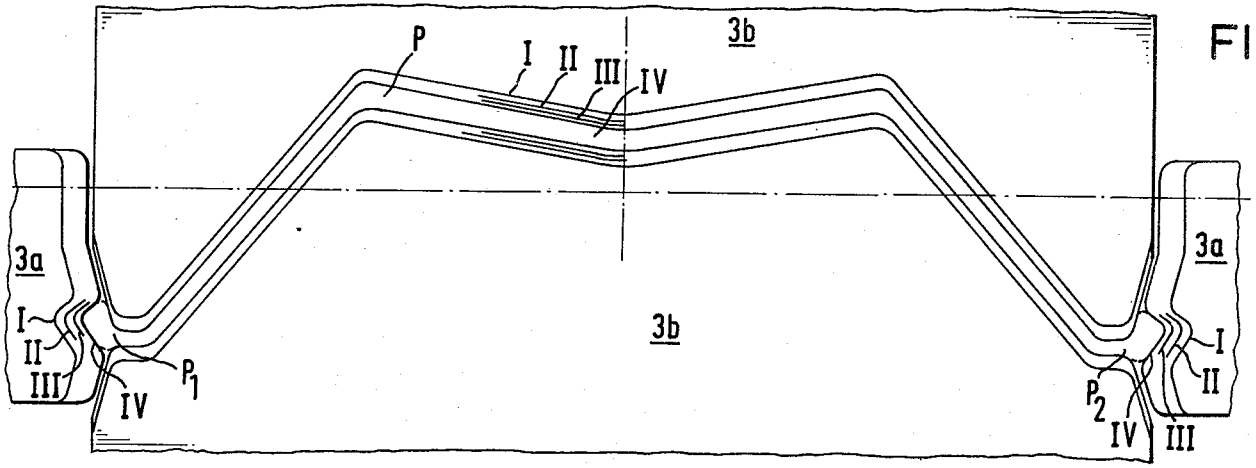
FIGS. 3, 3*a*, 3*b*, 3*c* and 3*d* show the sequence of passes in the intermediate and final group of rollers for rolling U-profile sheet steel piling.
Figure 3A:
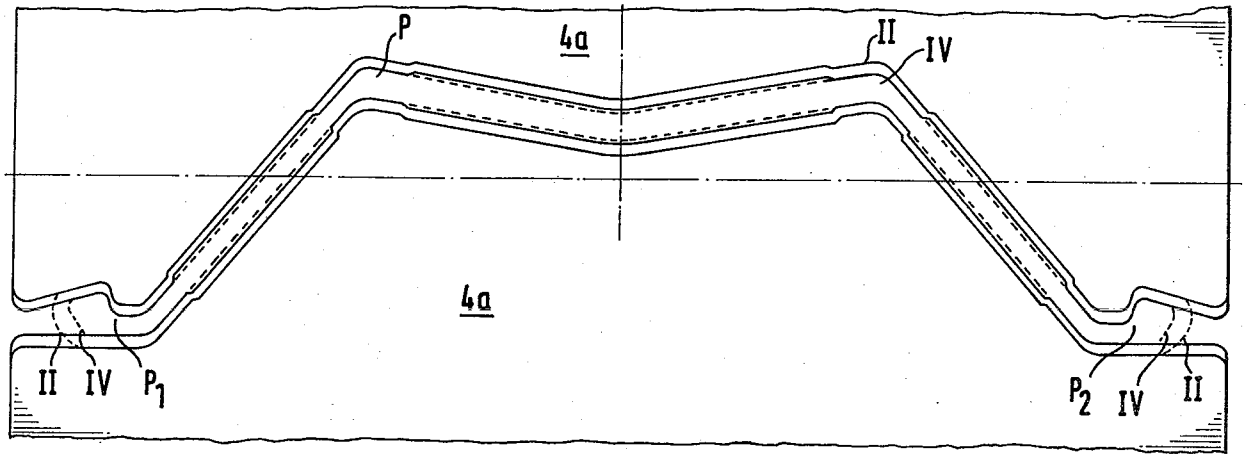
Figure 3B:
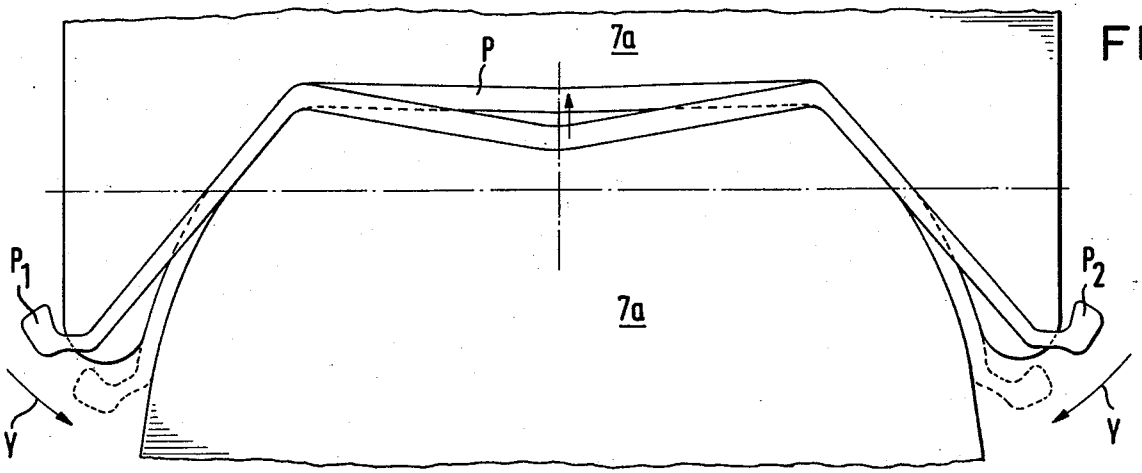
Figure 3C:
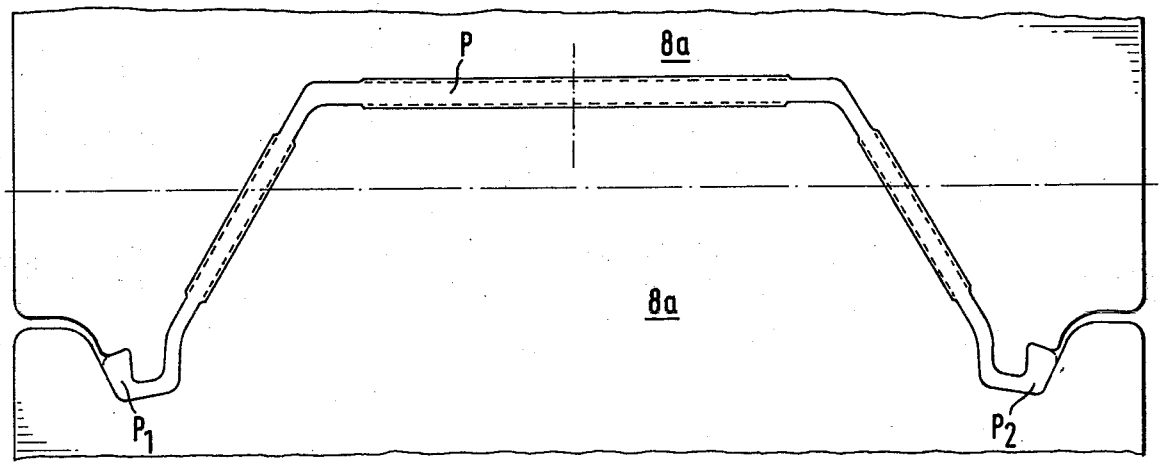

FIGS. 3, 3*a*, 3*b*, 3*c*, and 3*d* analogously illustrate the corresponding sequence of passes for U-shaped sheet steel piling profiles P in the sets 3*a* and 3*b* of rollers of the universal reversing rolling mill 3 and also of the edging mill 4, of the preliminary bending unit 7, and of the edging mill 8, and also of the sets 9*a* and 9*b* of rollers of the universal finishing rolling mill 9. As is illustrated in FIG. 3*b*, the preliminary bending of the sheet steel piling profile P takes place in the direction of the arrow Y.

Figure 3D:
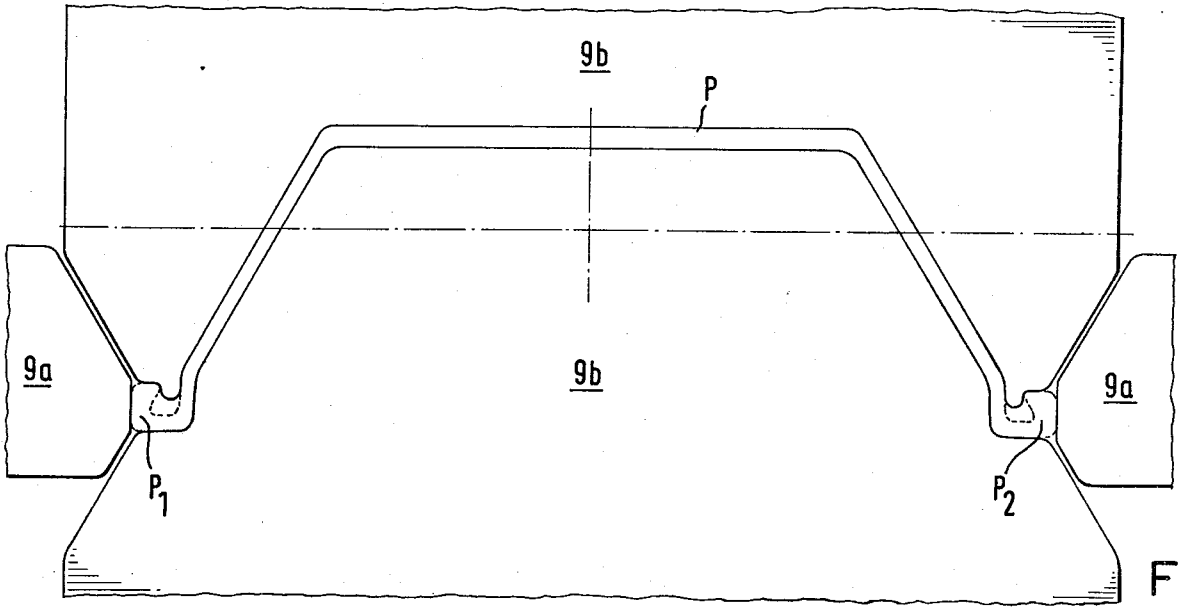

As is in particular illustrated in FIGS. 2*d* and 3*d* the final pass in the universal finishing roller mill 9 may alternatively only be carried out between the sets 9*b* of horizontal rollers or between the sets 9*b* of horizontal rollers and the sets 9*a* of vertical rollers.

I claim:

1. An improvement in a method of rolling steel sheet profiles of different cross-sectional shape in universal beam rolling mill trains wherein starting material is rolled in a two-high reversing ingot rolling mill, in a two-high reversing preliminary rolling mill, and in at least one universal rolling mill having an associated flange edging mill, rolling taking place in each instance by means of reversing operation and in plural sequences of passes, the material then being rolled to the final finishing profile in a following finishing rolling mill, the improvement comprising the following steps taking place continuously an unidirectionally:

initially preliminary bending the material profile to a starting shape with interlock joints and inner profiles;

shaping the interlock joints and the inner profiles suitably for the final profile; and subsequently performing a final finishing pass in which the cross-section of the sheet profile is dimensioned and shaped to its final profile.

2. A method according to claim 1, in which the step of performing a final finishing pass includes the rolling the sheet in a non-reversible universal finishing rolling mill, and wherein the step of shaping includes rolling the sheet in an edging roll mill.

3. A method according to claim 1, wherein the step of performing the final finishing pass includes rolling the sheet in a reversible universal rolling mill, and wherein the step of shaping includes rolling the sheet through an edging mill associated with said reversible universal rolling mill.

4. A method according to claim 1, wherein the step of bending includes bending only the interlock joints and the profile shape of the sheet to the starting shape.

5. A method according to claim 1, further comprising the steps of:

increasing the reduction of the sheet profile applied per pass through said at least one universal rolling mill, and restricting the number of passes of said sheet profile through said universal rolling mill, to provide a preliminary profile suitable for the final finishing pass.

6. A method according to claim 1, wherein the step of performing a final finishing pass includes passing the sheet steel profile between at least one set of a set of vertical rollers and a set of horizontal rollers.

7. Apparatus for rolling steel sheet profiles comprising, in sequence:

a two-high reversing ingot rolling mill, a two-high reversing preliminary rolling mill, at least one universal rolling mill having an associated flange edging mill which operates in reverse mode, a preliminary bending unit, an edging mill, and a universal finishing rolling mill, the mills being arranged in a continuous rolling line in the sequence stated.

8. Apparatus according to claim 7, wherein the finishing rolling mill is a non-reversible universal rolling mill, and wherein the preliminary bending unit and the edging mill are independent elements.

9. Apparatus according to claim 7, wherein the finishing rolling mill is a reversible universal rolling mill and wherein said edging mill is a flange edging mill which together with the reversible rolling mill consitutes a finishing roller group.

10. Apparatus according to claim 7, wherein said preliminary bending unit comprises at least one set of bending rollers.

11. Apparatus according to claim 7, wherein the edging mill is a light two-high rolling mill.

* * * * *